US006596227B2

(12) United States Patent
Shindo et al.

(10) Patent No.: US 6,596,227 B2
(45) Date of Patent: Jul. 22, 2003

(54) MACHINE STRUCTURE STEEL SUPERIOR IN CHIP DISPOSABILITY AND MECHANICAL PROPERTIES AND ITS METHOD OF MAKING

(75) Inventors: Yosuke Shindo, Kobe (JP); Hiroshi Yaguchi, Kobe (JP); Takehiro Tsuchida, Kobe (JP); Koichi Sakamoto, Kobe (JP); Masato Kaiso, Kobe (JP); Masami Somekawa, Kobe (JP); Ikuo Hoshikawa, Kakogawa (JP); Sei Kimura, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/935,583

(22) Filed: Aug. 24, 2001

(65) Prior Publication Data

US 2002/0044879 A1 Apr. 18, 2002

(30) Foreign Application Priority Data

Aug. 30, 2000 (JP) ..... 2000-261231
Sep. 6, 2000 (JP) ..... 2000-270762

(51) Int. Cl.[7] ..... C22C 36/60; C22C 38/04; C22C 38/02

(52) U.S. Cl. ..... 420/84; 420/87; 75/533; 75/536; 75/568

(58) Field of Search ..... 420/84, 87; 148/320; 75/533, 536, 568

(56) References Cited

U.S. PATENT DOCUMENTS 3,861,906 A 1/1975 Tipnis et al.
4,004,922 A 1/1977 Thivellier et al.
4,255,188 A 3/1981 Riekels
4,279,646 A 7/1981 Kato et al.
4,806,304 A 2/1989 Kimura et al.

FOREIGN PATENT DOCUMENTS

| | | |
|---|---|---|
| EP | 0 919 636 | 6/1999 |
| JP | 59-205453 | 11/1984 |
| JP | 62-23970 | 1/1987 |
| JP | 5-271743 | 10/1993 |
| JP | 5-311225 | 11/1993 |
| JP | 7-188853 | 7/1995 |
| JP | 7-238342 | 9/1995 |
| JP | 8-225822 | 9/1996 |
| JP | 2000-87179 | 3/2000 |

OTHER PUBLICATIONS

Derwent Abstract, JP 48–071714, Sep. 28, 1973.

*Primary Examiner*—Deborah Yee
(74) *Attorney, Agent, or Firm*—Oblon, Spivak, McClelland, Maier & Neustadt, P.C.

(57) ABSTRACT

A machine structure steel superior in chip disposability and mechanical properties which contains sulfide-type inclusions such that those particles of sulfide-type inclusions with major axes not shorter than 5 μm have an average aspect ratio not larger than 5.2 and which also contains coarse particles of sulfide-type inclusions such that the relation $a/b \leqq 0.25$ is satisfied, where a denotes the number of particles of sulfide-type inclusions with major axes not shorter than 20 μm, and b denotes the number of particles of sulfide-type inclusions with major axes not shorter than 5 μm. The machine structure steel exhibits good chip disposability and mechanical properties despite its freedom from lead.

16 Claims, 1 Drawing Sheet

MACHINE STRUCTURE STEEL SUPERIOR IN CHIP DISPOSABILITY AND MECHANICAL PROPERTIES AND ITS METHOD OF MAKING

BACKGROUND OF THE INVENTION

1. Field of the Invention

The present invention relates to a machine structure steel and a process for production thereof, said steel being useful as a raw material to be made into parts of industrial machines, automobiles, and electric appliances by machining. More particularly, the present invention relates to a machine structure steel and a process for production thereof, said steel being superior in chip disposability and mechanical properties despite its substantial freedom from lead (Pb) as a machinability improving component.

2. Description of the Related Arts

Good machinability is required of a steel to be made into parts of industrial machines, automobiles, and electric appliances by machining. A conventional way to improve the machinability of a machine structure steel for such parts is to incorporate the steel with lead (Pb) or sulfur (S) as a machinability improving component. It is known that lead (Pb) even in a small amount greatly improves machinability.

Japanese Patent Laid-open No. 205453/1984 discloses a free machining steel which is incorporated with S, Te, Pb, and Bi in combination. This steel is characterized by its specific inclusions. That is, it contains MnS-type inclusions such that those which have a ratio of major axis to minor axis smaller than 5 account for more than 50% of all. It also contains oxide-type inclusions such that $Al_2O_3$ accounts for not more than 15% of all.

Also, Japanese Patent Laid-open No. 23970/1987 discloses a free machining steel which is based on a low-carbon steel made by continuous casting process and incorporated with sulfur and lead. This steel contains C, Mn, P, S, Pb, O, Si, and Al in specific amounts and also contains MnS-type inclusions with a specific average size and sulfide-type inclusions (not combined with oxides) in a specific ratio.

The above-mentioned disclosures are concerned with a free machining steel incorporated with lead and sulfur in combination. There is a tendency in the steel industry toward avoiding the use of lead in reaction to the environmental pollution with lead which is an urgent social issue. Active studies are being made on the improvement of machinability without resort to lead.

Japanese Patent Laid-open No. 87179/2000 discloses a carbon steel or alloy steel for machine structural use which is incorporated with Ca, Mg, and REM (rare earth metal) in combination for superior wear resistance and chip disposability required of machining with a cemented carbide tool. However, it only mentions the composition of sulfide-type inclusions and it does not mention the size of sulfide-type inclusions which has a crucial influence on machinability and mechanical properties.

Japanese Patent Laid-open No. 188853/1995 discloses a carburizing steel for gears which contains 0.0015–0.0350% T.Mg (total Mg) in addition to such basic components as C, Si, Mn, Cr, P, S, T.O (total O). It claims that Mg added to the steel combines with $Al_2O_3$ to form $MgO.Al_2O_3$ or MgO, making oxide inclusions (mainly alumina) fine, which results in reduction in ductility (due to MnS) and improvement in surface fatigue strength and gear tooth bending fatigue strength. However, it mentions nothing about improvement in impact resistance (in lateral direction) and machinability.

Japanese Patent Laid-open No. 238342/1995 discloses a high-strength carburizing steel for gears which is specified by the content of oxides and sulfides (in terms of number of particles) which satisfies the following conditions.

$$\frac{\text{Number of } (MgO + MgO \cdot Al_2O_3)}{\text{Total number of oxides}} \geq 0.80 \quad (1)$$

$$0.20 \leq \frac{\text{Number of } (Mn \cdot Mg)S}{\text{Total number of sulfides}} \geq 0.70 \quad (2)$$

This steel is an improvement over that disclosed in Japanese Patent Laid-open No. 188853/1995 just mentioned above. The disclosure claims that oxides and sulfides in specific amounts as set forth by (1) and (2) above greatly improve surface fatigue strength and gear tooth bending fatigue strength. However, it mentions nothing about improvement in machinability and impact resistance in lateral direction.

In the meantime, it is known in other field than free-machining steel that oxide-type inclusions, particularly alumina ($Al_2O_3$) inclusions, in steel produce such adverse effects as breakage in the case of wire rod such as tire cord, rolling fatigue in the case of bar steel such as bearing quality steel, and cracking at the time of can making in the case of thin steel sheet for DI process. For alleviation of these adverse effects, several attempts were made to reduce the amount of alumina-type inclusions. One way disclosed in Japanese Patent No. 2140282, for example, is to add a Mg alloy to a molten steel containing Si, Mn, Al, and C, thereby preventing $Al_2O_3$ in the steel from becoming coarse through aggregation. Mg added to a molten steel converts $Al_2O_3$ into $MgO.Al_2O_3$ which is fine particles having no adverse effect on the steel.

Also, Japanese Patent Laid-open No. 225822/1996 discloses an improvement on a steel containing Al and S by sequential addition of Ca and Mg. These additives convert alumina inclusions in the steel into a binary oxide (CaO—$Al_2O_3$) or a ternary oxide (CaO—$Al_2O_3$—MgO), which has a lower melting point. To be more specific, upon addition of Ca and Mg to a molten steel, such inclusions as $Al_2O_3$ and CaS which cause nozzle clogging change into compound oxides having a lower melting point than $12CaO.7Al_2O_3$, without forming CaS in an appreciable amount. The steel modified in this way is free from nozzle clogging. The above-mentioned method is applied to an Al-killed steel to prevent $Al_2O_3$ from becoming coarse through aggregation. Therefore, the molten steel already contains Al before incorporation with Mg.

In addition, Japanese Patent No. 2684307 discloses a method of efficiently preventing $Al_2O_3$ from aggregation in a molten steel by addition of an Mg—Al alloy to a molten steel containing Si, Mn, and C. Adding Mg and Al simultaneously in the form of alloy permits efficient and rapid reactions. The result is an improved yield per unit amount of Mg added. Unfortunately, Mg readily vaporizes and hence does not remain as much as Al in the molten steel when Mg and Al are added simultaneously. Consequently, $Al_2O_3$ is much more prone to occur, creating a state very similar to that which would be if Al is added first. In other words, Mg added simultaneously with Al is not so effective in dispersing inclusions in the form of fine particles.

As mentioned above, attempts made so far to improve machinability are based mainly on controlling the size and shape of sulfide-type inclusions (such as MnS) in resulfurized carbon steel. However, none of free-machining steel has been realized which is comparable to leaded carbon steel. Moreover, any attempt to control the size and shape of sulfide-type inclusions causes MnS particles to elongate as the base metal (steel) undergoes plastic deformation during rolling or forging. The elongated MnS particles cause mechanical anisotropy, with the result that the steel has a lower impact value in one direction than in other directions.

Now, machinability is rated in terms of (1) cutting resistance, (2) tool life, (3) finished surface roughness, and (4) chip disposability. In the past, importance was attached to the second and third items. However, the fourth item has recently become important from the standpoint of working efficiency and safety as automated or unmanned machining has become common. Chip disposability is an ability of steel to become small chips after cutting. With poor chip disposability, a work tends to give rise to long coiled chips which entangle with the cutting tool. As long as chip disposability is concerned, the conventional lead-containing free-cutting steel is satisfactory; however, so far there is no lead-free steel having good chip disposability.

OBJECT AND SUMMARY OF THE INVENTION

The present invention was completed in order to address the above-mentioned problems. It is an object of the present invention to provide a machine structure steel and a process for production thereof, said steel being superior in chip disposability and mechanical properties despite its substantial freedom from lead.

The present invention is directed to a machine structure steel superior in chip disposability and mechanical properties which contains sulfide-type inclusions such that those particles of sulfide-type inclusions with major axes in a specific range have a controlled average aspect ratio and which also contains coarse particles of sulfide-type inclusions in a limited number.

To be more specific, the gist of the present invention resides in a machine structure steel superior in chip disposability and mechanical properties which contains sulfide-type inclusions such that those particles of sulfide-type inclusions with major axes not shorter than 5 $\mu$m have an average aspect ratio not larger than 5.2 and which also contains coarse particles of sulfide-type inclusions such that the following relation is satisfied.

$$a/b \leqq 0.25$$

where, a denotes the number of particles of sulfide-type inclusions with major axes not shorter than 20 $\mu$m, and b denotes the number of particles of sulfide-type inclusions with major axes not shorter than 5 $\mu$m.

The aspect ratio in the present invention is defined as c/d, where c and d respectively denote the major axis and minor axis of a particle of sulfide-type inclusions. The major axis of a particle is defined as the diameter of the maximum circle circumscribing the particle. The minor axis of a particle is defined as the maximum width of the particle measured in the direction perpendicular to the diameter of the maximum circle.

According to a preferred embodiment, the machine structure steel of the present: invention satisfies the condition that $[Mg]/[S] \geqq 7.7\times10^{-3}$ (where [ ] denotes the content (mass %) of each component), those particles of sulfide-type inclusions with major axes not shorter than 50 $\mu$m have an average aspect ratio not larger than 10.8, and $a/b \leqq 0.25$ (where a and b are defined as above).

According to another preferred embodiment, the machine structure steel of the present invention satisfies the condition that $([Mg]+[Ca])/[S] \geqq 7.7\times10^{-3}$ (where [ ] denotes the content (mass %) of each component), those particles of sulfide-type inclusions with major axes not shorter than 50 $\mu$m have an average aspect ratio not larger than 10.8, and $a/b \leqq 0.25$ (where a and b are defined as above).

According to another preferred embodiment, the machine structure steel of the present invention contains 0.01–0.7% C, 0.01–2.5% Si, 0.1–3% Mn, 0.01–0.16% S, not more than 0.05% P (0% inclusive), not more than 0.1% Al (0% inclusive), and not more than 0.02% Mg (0% not inclusive). It may additionally contain not more than 0.02% Ca (0% not inclusive) and not more than 0.3% Bi (0% not inclusive). "%" means "mass %", and the same shall apply herein after.

The present invention is also directed to a process for producing a machine structure steel, said process comprising a step of adding a substantially Al-free Mg alloy to a substantially Al-free molten steel. This process may be modified such that addition of said Mg alloy is followed by addition of Al.

The present invention is also directed to a process for producing a machine structure steel, said process comprising a step of adding a substantially Al-free Mg alloy and a subsequent step of adding a substantially Al-free Ca alloy to a substantially Al-free molten steel. This process may be modified such that addition of said Ca alloy is followed by addition of Al.

The present invention is also directed to a process for producing a machine structure steel, said process comprising a step of adding a substantially Al-free Mg alloy and a substantially Al-free Ca alloy all together as many times as necessary to a substantially Al-free molten steel, or said process comprising a step of adding a substantially Al-free Mg alloy earlier than a substantially Al-free Ca alloy and then adding these two alloys in any order as many times as necessary. This process may be modified such that addition of said Mg alloy and said Ca alloy is followed by addition of Al.

The above-mentioned process may be carried out efficiently if the molten steel is covered with a slag containing 15% or more MgO.

DESCRIPTION OF THE PREFERRED EMBODIMENTS

Figure 1:
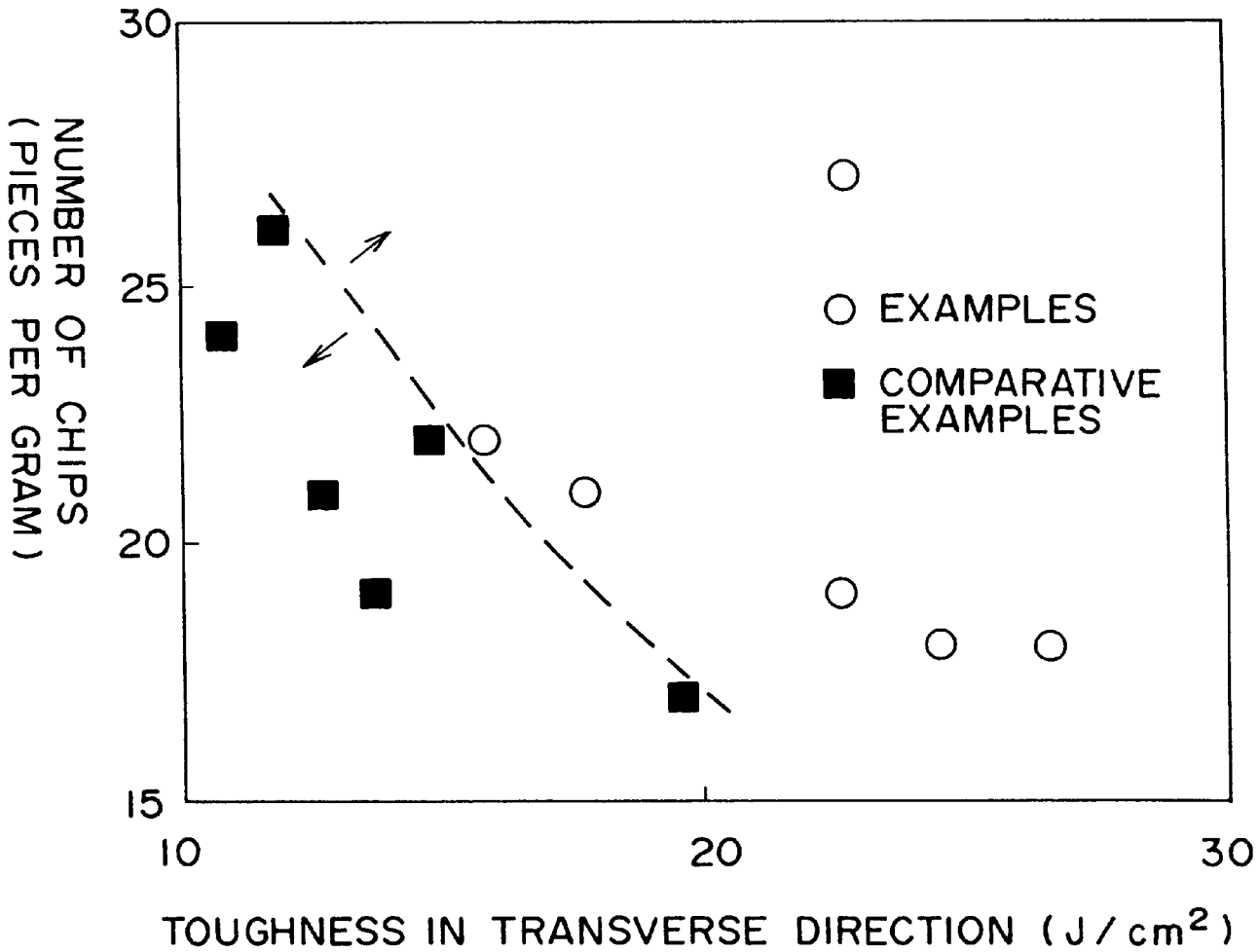
FIG. 1 is a graph showing the relation between the toughness in transverse direction and the number of chips.

The present inventors carried out extensive investigation for development of a machine structural steel superior in both chip disposability and toughness (or toughness in transverse direction which is defined as impact strength measured in the direction perpendicular to the direction in which a steel is elongated by rolling or forging). As the result, it was found that such a machine structural steel can be obtained if an adequate control is imposed on the shape and size of sulfide-type inclusions (such as MnS) therein. In other words, for a machine structure steel to have improved chip disposability, it is desirable that sulfide-type inclusions therein be coarse particles. Also, for a machine structure steel to have improved toughness in transverse direction, it is desirable that sulfide-type inclusions be fine spherical particles. Therefore, a machine structure steel will have both of these properties if it contains sulfide-type inclusions which are approximately spherical particles having a size within a certain range.

It was found that there exist Mg and Ca oxides in approximately spherical sulfide-type inclusions contained in a machine structure steel which has both of the above-mentioned properties. It was also found that there exist no Mg and Ca oxides in coarse elongated sulfide-type inclusions contained in a machine structure steel which is poor in toughness in transverse direction. This fact suggests that sulfide-type inclusions grow from Mg and Ca oxides as nuclei and sulfide-type inclusions take on a form desirable for a machine structure steel to have both of the above-mentioned properties if said oxides dissolve in sulfide-type inclusions to form a solid solution.

If a machine structure steel is produced in such a way that Mg and Ca oxides are intentionally formed, the resulting steel will contain sulfide-type inclusions with a desired shape and size and hence will have both improved chip disposability and improved toughness in transverse direction. This is the basis on which the present invention was completed.

The Mg and Ca oxides as nuclei for sulfide-type inclusions are intentionally formed by selecting an adequate time for addition of Mg and Ca in the period of steel making.

The following is a detailed description of the present invention.

The first embodiment of the present invention covers a machine structure steel which contains sulfide-type inclusions such that those particles of sulfide-type inclusions with major axes not shorter than 5 $\mu$m have an average aspect ratio not larger than 5.2 and which also contains coarse particles of sulfide-type inclusions such that the following relation is satisfied.

$$a/b \leqq 0.25$$

where, a denotes the number of particles of sulfide-type inclusions with major axes not shorter than 20 $\mu$m, and b denotes the number of particles of sulfide-type inclusions with major axes not shorter than 5 $\mu$m.

In the above-mentioned embodiment, those particles of sulfide-type inclusions with major axes not shorter than 5 $\mu$m should have an average aspect ratio not larger than 5.2, preferably not larger than 5.0, and more preferably not larger than 4.5. With an average aspect ratio exceeding the above-mentioned limit, the sulfide-type inclusions take on an elongated shape rather than an approximately spherical shape; therefore, the resulting machine structure steel is poor in toughness in transverse direction. Incidentally, the above-mentioned aspect ratio has no specific lower limit. In other words, the particles of inclusions may be spherical (with an aspect ratio of 1).

In the above-mentioned embodiment, the ratio of a/b should be not larger than 0.25, preferably not larger than 0.20. With a value of a/b exceeding the above-mentioned limit, the resulting machine structure steel contains a large number of coarse sulfide-type inclusions and hence is poor in toughness in transverse direction. Incidentally, the value of a/b has no lower limit, and it may be 0.

The present invention is not concerned with sulfide-type inclusions having major axes smaller than 5 $\mu$m, because such fine inclusions are considered to have no significant effect on chip disposability and toughness in transverse direction.

The second embodiment of the present invention covers a machine structure steel which satisfies the condition that $[Mg]/[S] \geqq 7.7\times10^{-3}$ (where [ ] denotes the content (mass %) of each component), those particles of sulfide-type inclusions with major axes not shorter than 50 $\mu$m have an average aspect ratio not larger than 10.8, and $a/b \leqq 0.25$ (where a and b are defined as above).

In the above-mentioned second embodiment, those particles of sulfide-type inclusions with major axes not shorter than 50 $\mu$m should have an average aspect ratio not larger than 10.8, preferably not larger than 10.5. With an average aspect ratio exceeding the above-mentioned limit, the sulfide-type inclusions take on an elongated shape rather than an approximately spherical shape; therefore, the resulting machine structure steel is poor in toughness in transverse direction. Incidentally, the above-mentioned aspect ratio has no specific lower limit. In other words, the particles of inclusions may be spherical (with an aspect ratio of 1).

Also, in the above-mentioned second embodiment, the value of [Mg]/[S] should be not smaller than $7.7\times10^{-3}$, preferably not smaller than $1.5\times10^{-2}$. With a value smaller than the specified limit, the resulting machine structure steel does not sufficiently contain Mg oxides that control the shape and size of sulfide-type inclusions and hence contains a large number of coarse sulfide-type inclusions which impair toughness in transverse direction. The value of [Mg]/[S] has no specific upper limit; it is determined by the upper limit of the amount of Mg and the lower limit of the amount of S.

The third embodiment of the present invention covers a machine structure steel which satisfies the condition that $([Mg]+[Ca])/[S] \geqq 7.7\times10^{-3}$ (where [ ] denotes the content (mass %) of each component), those particles of sulfide-type inclusions with major axes not shorter than 50 $\mu$m have an average aspect ratio not larger than 10.8, and $a/b \leqq 0.25$ (where a and b are defined as above).

In the above-mentioned third embodiment, the value of ([Mg]+[Ca])/[S] should be not smaller than $7.7\times10^{-3}$, preferably not smaller than $1.5\times10^{-2}$. With a value smaller than the specified limit, the resulting machine structure steel does not sufficiently contain Mg and Ca oxides that control the shape and size of sulfide-type inclusions and hence contains a large number of coarse sulfide-type inclusions which impair toughness in transverse direction. The value of ([Mg]+[Ca])/[S] has no specific upper limit; it is determined by the upper limit of the amount of Mg and Ca and the lower limit of the amount of S.

Samples for measurements of the shape and size of sulfide-type inclusions should be taken from that part of the machine structure steel which is free from segregation and aggregation of oxide-type and sulfide-type inclusions.

A mention is made below of the chemical components of the machine structure steel of the present invention.

C: 0.01–0.7%

C is the most important element that determines the strength of the final product. From this standpoint, the lower limit of C content should be 0.01%, preferably 0.10% or above. However, the upper limit of C content should be 0.7%, preferably 0.55%, because an excessive C content has an adverse effect on toughness and tool life.

Si: 0.01–2.5%

Si functions as a deoxidizer and imparts high strength to machine parts through solid-solution hardening. For Si to produce its effect, the lower limit of Si content should be 0.01%, preferably 0.03%. However, the upper limit of Si content should be 2.5%, preferably 1.5%, because an excessive Si content has an adverse effect on machinability.

Mn: 0.1–3%

Mn improves the hardenability of steel, thereby contributing to strength. It also forms sulfide-type inclusions, thereby contributing to chip disposability. From this standpoint, the lower limit of Mn content should be 0.1%, preferably 0.3%. However, the upper limit of Mn content should be 3%, preferably 2%, because an excessive Mn content has an adverse effect on machinability.

S: 0.01–0.16%

S forms sulfide-type inclusions, thereby improving chip disposability. From this standpoint, the lower limit of S content should be 0.01%, preferably 0.03%. However, the upper limit of S content should be 0.16%, preferably 0.14%, because excessive S forms sulfides (such as MnS) from which cracking propagate.

P: Not More than 0.05% (0% Inclusive)

P causes grain boundary segregation, thereby deteriorating impact resistance. Therefore, the P content should be not more than 0.05%, preferably not more than 0.02%.

Al: Not More than 0.1% (0% Inclusive)

Al is an important deoxidizer in steel making. It also forms nitrides which make austenite grains fine. However, excessive Al yields coarse grains, producing an adverse effect on toughness. The upper limit of Al content should be 0.1%, preferably 0.05%.

As mentioned later in more detail, Al is an important element in the present invention. It is added together with Mg and Ca to molten steel at an adequate time in the production process.

Mg: Not More than 0.02% (0% Not Inclusive)

Mg functions as a deoxidizer. It forms fine oxides which nucleate sulfide-type inclusions for their uniform dispersion. The fine oxides dissolve in sulfide-type inclusions to form a solid solution, thereby preventing the sulfide-type inclusions from elongating. An excess Mg content leads to a higher production cost. The upper limit of Mg content should be 0.02%, preferably 0.01%. Although the lower limit of Mg content is not specified, an adequate Mg content should be such that the value of [Mg]/[S] is not lower than $7.7\times10^{-3}$, preferably not lower than $1.5\times10^{-2}$.

Ca: Not More than 0.02% (0% Inclusive)

Although Ca is less effective than Mg in evenly dispersing sulfide-type inclusions, it effectively prevents coarse sulfide-type inclusions from elongating. When added in combination with Mg, Ca enhances Mg's effect of preventing sulfide-type inclusions from elongating. Like Mg, Ca increases production cost if added in an excess amount. The upper limit of Ca content should be 0.02%, preferably 0.01%. Although the lower limit of Ca content is not specified, an adequate Ca content should be such that the value of ([Mg]+[Ca])/[S] is not lower than $7.7\times10^{-3}$, preferably not lower than $1.5\times10^{-2}$.

Bi: Not More than 0.3% (0% Not Inclusive)

Bi effectively improves machinability. Bi in an excess amount does not produce any additional effect but deteriorates hot forgeability and mechanical properties. The upper limit of Bi content should be 0.3%, preferably 0.1%. Although the lower limit of Bi content is not specified, it should preferably be 0.01% so that it produces its effect as mentioned above.

The machine structure steel of the present invention is produced by the process explained in the following.

Crystallization of sulfide-type inclusions in Al-killed steel is nucleated by $Al_2O_3$. Unfortunately, it is known that $Al_2O_3$ aggregates into coarse clusters in molten steel. In other words, coarse $Al_2O_3$ leads to coarse sulfide-type inclusions.

In the process of the present invention, this problem is solved by adding a substantially Al-free Mg alloy to a substantially Al-free molten steel. This alloy forms MgO as oxide-type inclusions, and this MgO acts as nuclei of sulfide-type inclusions. MgO is less subject to aggregation and clustering than $Al_2O_3$. As the result, oxide-type inclusions become dispersed fine particles and sulfide-type inclusions do not become coarse.

Upon cooling a molten steel containing a large number of MgO particles dispersed therein, MgO particles act as nuclei of MgS and, upon further cooling, the resulting MgS particles in turn act as nuclei of MnS and other sulfide-type inclusions. Alternatively, MgO particles act as nuclei of MgS and MnS. The consequence is that the resulting sulfide-type inclusions contain a large amount of Mg and hence they hardly deform (or elongate) at the time of rolling. This contributes to a free-machining steel having both good mechanical properties (impact strength in transverse direction) and good chip disposability.

As mentioned above, $Al_2O_3$ aggregates into coarse clusters in molten steel. This is due to an extremely poor wettability of $Al_2O_3$ by molten steel. By contrast, MgO is easily wetted by molten steel; therefore, MgO does not form clusters unlike $Al_2O_3$. This is because MgO has a smaller interfacial surface energy than $Al_2O_3$. Japanese Patent No. 2684307 discloses a process of converting $Al_2O_3$ in molten steel into $MgO.Al_2O_3$ by adding Mg to the molten steel. (There is an instance where the $MgO.Al_2O_3$ is further converted into MgO.) On account of their lower interfacial surface energy, $MgO.Al_2O_3$ and MgO particles are small in size and less liable to clustering. However, if $Al_2O_3$ particles aggregate into coarse particles before Mg is added to molten steel and $Al_2O_3$ is converted into $MgO.Al_2O_3$, the molten steel contains coarse sulfide-type inclusions. This does not hold in the present invention, in which a substantially Al-free Mg alloy is added to a substantially Al-free molten steel. The Mg alloy forms MgO, which disperses into the molten steel. The MgO particles have a smaller interfacial surface energy than $Al_2O_3$ particles and are small in size and less liable to clustering. Therefore, even though Al is added after the Mg alloy has been added, $MgO.Al_2O_3$ and $Al_2O_3$ hardly occur, because MgO has already occurred when Al is added. In other words, Al does not function as a deoxidizer but it makes crystalline particles fine during working and heat treatment. Even though MgO changes into $MgO.Al_2O_3$ or $Al_2O_3$-rich compound oxide of MgO and $Al_2O_3$, the object of the present invention is achieved because this reaction is very slow.

The process of the present invention also comprises a step of sequentially adding a substantially Al-free Mg alloy and a substantially Al-free Ca alloy to a substantially Al-free molten steel. The sequential addition of Mg and Ca forms CaO and CaS in molten steel. This CaO functions as part of the oxide-type inclusions. Like MgO, it acts as nuclei of sulfide-type inclusions. The CaS-containing sulfide-type inclusions are less subject to elongation (like Mg-containing sulfide-type inclusions) as compared with Mg-free sulfide-type inclusions. Therefore, they contribute to the mechanical properties (particularly impact strength in transverse direction) of steel by the following mechanism. A large number of oxide-type inclusions (such as MgO) formed in molten steel act as nuclei of MgS and CaS. Upon further cooling, MgS and CaS nucleate MnS and other sulfide-type inclusions. Alternatively, oxide-type inclusions (such as MgO) act as nuclei of MgS, CaS, MnS, etc. As the result, sulfide-type inclusions contain a large amount of Mg and Ca, and hence they are less liable to deformation. In other words, they hardly elongate at the time of rolling, and this property contributes to a free-machining steel having both good mechanical properties (particularly impact strength in transverse direction) and good chip disposability. For better effect, Al may be added after Ca has been added.

The process of the present invention also comprises a step of simultaneously adding a substantially Al-free Mg alloy and a substantially Al-free Ca alloy to a substantially Al-free molten steel, or a step of adding a substantially Al-free Mg alloy earlier than a substantially Al-free Ca alloy and then adding these two alloys in any order as many times as necessary. The simultaneous addition of Mg alloy and Ca alloy forms oxides containing MgO and CaO, which act as nuclei of sulfide-type inclusions. They are not subject to aggregation and clustering, and hence the resulting sulfide-type inclusions do not become coarse. The second mode of addition improves yields and contributes to a free-machining steel having good mechanical properties and good chip disposability. For better effect, Al may be added after the Mg alloy and Ca alloy have been added.

In the case where a Ca alloy is added first, Ca reacts with a trace amount of $Al_2O_3$ present in molten steel to form $CaO.Al_2O_3$. This $CaO.Al_2O_3$ can act as nuclei of sulfide-type inclusions, but it tends to become coarse inclusions and the resulting sulfide-type inclusions are also coarse. Therefore, this mode of addition is a hindrance to achieving the object of the present invention.

The molten steel used in the present invention should preferably be one which is substantially free of Al. To be more specific, the upper limit of Al content in molten steel is 0.005 mass %. Al present in excess of this limit forms $Al_2O_3$ before the addition of Mg. This is a hindrance to achieving the object of the present invention.

It is desirable that the Mg alloy and Ca alloy used in the present invention be substantially free of Al. To be more concrete, the upper limit of Al content in the Mg alloy and Ca alloy should be 1 mass %. The smaller, the better. If an alloy containing more than 1% Al is added to molten steel, Al in the alloy combines with oxygen in the molten steel, thereby forming $Al_2O_3$, which in turn forms aggregates and clusters. This situation is similar to that which occurs when Al is added first. Under this situation, the object of the present invention is not achieved. Incidentally, in the case where the Mg and Ca alloys are added all together, the upper limit of Al content in the two alloys is 1.2 mass %.

The method of adding Mg and Ca is not specifically restricted. However, it is necessary to select an adequate method while keeping in mind the fact that Mg and Ca have a high vapor pressure and are easily lost by evaporation and oxidation. One way is to fill an iron wire with an Mg alloy or Ca alloy in granular form and add the iron wire to molten steel. Another way is to blow the granular alloy together with an inert gas into molten steel. In view of poor retention of Mg and Ca in molten steel, the Mg alloy and Ca alloy should be added in small portions several times to molten steel in a ladle, tundish, or mold. This is desirable from the standpoint of an efficient steel making process.

Since Mg and Ca are easily oxidizable elements, it is a desirable practice to cover molten steel with slag so as to prevent their loss by oxidation with atmospheric air. In this case, the slag should contain MgO in an amount not less than 15 mass %, preferably not less than 20 mass %, to supply sufficient nuclei for crystallization, because the slag will absorb MgO and CaO (resulting from Mg and Ca added) if it does not contain MgO and CaO. Likewise, in the case of adding Ca to molten steel, it is a desirable practice to use a slag containing CaO in an amount not less than 15 mass %, preferably not less than 20 mass %.

The process of the present invention ends with casting the molten steel into a desired form. Casting is followed by working in any known method without specific restrictions. For example, an ingot may be rolled into a steel bar in such a way that the sectional area of the ingot is decreased by 92–97%. Such working as forging and rolling affects the shape of sulfide-type inclusions in steel. However, the machine structure steel of the present invention retains good chip disposability and toughness in transverse direction even after such working so long as it contains sulfide-type inclusions having the shape and size within the above-mentioned range.

Incidentally, the present invention deals with sulfide-type inclusions which are not specifically restricted. They include sulfides of Mn, Ca, Mg, Zr, REM, and other elements (such as Ni, Cr, Cu, Mo, V, Nb, Ti, Zr, Pb, and Bi). Sulfides may be in the form of compound sulfides, carbide-sulfides, or acid-sulfides.

EXAMPLES

The invention will be described in more detail with reference to the following examples, which are not intended to restrict the scope of the invention. Any modification and changes may be made without departing from the scope of the invention.

Thirteen steel samples varying in composition as shown in Table 1 were prepared as follows.

Process for samples Nos. 1 to 7. A molten steel produced by a converter is given Si, Mn, and Cr at the time of tapping into a ladle. The molten steel in the ladle undergoes vacuum degassing and deoxidizing. Then it is incorporated with Si, Mn, Cr, and S (and Bi in No. 5). In this way there is obtained a substantially Al-free molten steel. The molten steel in the ladle is given a Ni—Mg alloy alone or in combination with a Ni—Ca alloy. (To be concrete, an iron wire filled with granules of the alloy is added to the molten steel.)

Process for samples Nos. 8, 9, and 13. A molten steel produced by a converter is given Si, Mn, Cr, and Al at the time of tapping into a ladle. The molten steel in the ladle undergoes vacuum degassing and deoxidizing. Then it is incorporated with Si, Mn, Cr, Al, and S. In this way there is obtained a molten steel containing 0.02% Al. The molten steel in the ladle is given a Ni—Mg alloy alone or in combination with a Ni—Ca alloy. (To be concrete, an iron wire filled with granules of the alloy is added to the molten steel.)

Process for samples Nos. 1, 3, 5, 6, 8, and 13. The molten steel is shielded with a slag containing 25% MgO.

Process for samples Nos. 2, 4, 7, and 9. The molten steel is shielded with a slag containing 25% MgO and 25% CaO.

Process for samples Nos. 10 and 12. A molten steel produced by a converter is given Si, Mn, Cr, Al, and Ni at the time of tapping into a ladle. The molten steel in the ladle undergoes vacuum degassing and deoxidizing. Then it is incorporated with Si, Mn, Cr, Al, S, and Ni. In this way there is obtained the desired molten steel.

Process for sample No. 11. A molten steel produced by a converter is given Si, Mn, and Cr at the time of tapping into a ladle. The molten steel in the ladle undergoes vacuum degassing and deoxidizing. Then it is incorporated with Si, Mn, Cr, and S. In this way there is obtained a substantially Al-free molten steel. The molten steel in the ladle is given a Ni—Ca alloy. (To be concrete, an iron wire filled with granules of the alloy is added to the molten steel.) Finally, Al is added so that the resulting steel contains 0.02% Al.

Each molten steel was cast at 1580° C. into an ingot measuring 245 mm in top diameter, 210 mm in bottom diameter, and 350 mm high and weighing 150 kg. The ingot was forged at 1200° C. into a round bar which has a diameter of 52 mm corresponding to a reduction of area by 96%. Out of the bar was cut a specimen, 30 mm long, for evaluation of the following items.

Shape and Size of Sulfide-type Inclusions

The specimen was cut in the direction in which sulfide-type inclusions were elongated. The cut surface was observed under an image analyzer, Model LUZEX F, made by Nireco Co., Ltd. Sulfide-type inclusions in a visual field of 5.5×5.5 mm (magnification of ×100) were examined for major axes and minor axes. The observed image underwent binarizing processing, with the RGB level maintained at R: 125/180, G: 110/180, and B: 120/180. The gray level was adequately adjusted according to brightness so that the sulfide-type inclusions are clearly distinguished from the matrix. Aspect ratios of individual particles were calculated from the measured major axes and minor axes. Their average value was regarded as the aspect ratio of the sulfide-type inclusions in the specimen.

Chip Disposability

The specimen was tested for chip disposability by dry drilling of a 10-mm deep hole at a cutting speed of 20 m/min and a feed speed of 0.2 mm/rev with a straight drill (10 mm in diameter) made by high-speed steel. Chip disposability was rated in terms of the number of pieces in one gram of chips, which was calculated from the total number and weight of chips collected from three drilling holes.

Toughness in Transverse Direction

Specimens (conforming to JIS Z2202, No. 3) were cut out of the steel samples according to JIS G0303. For measurement of impact strength in transverse direction, each specimen was given a notch which is perpendicular to the forging direction. Tests were carried out at normal temperature according to JIS Z2242 with a Charpy impact tester (vertical type, made by Tokyo Kouki Seizousho Co., Ltd.)

The results of the tests are shown in Tables 2 and 3.

TABLE 3

| Sample | Toughness in transverse direction (J/cm$^2$) | Number of chips per gram |
|---|---|---|
| 1 | 15.7 | 22 |
| 2 | 17.7 | 21 |
| 3 | 24.5 | 18 |
| 4 | 26.5 | 18 |
| 5 | 22.6 | 27 |
| 6 | 22.6 | 19 |
| 7 | 15.7 | 22 |
| 8 | 12.7 | 21 |
| 9 | 13.7 | 19 |
| 10 | 10.8 | 24 |
| 11 | 11.8 | 26 |
| 12 | 14.7 | 22 |
| 13 | 19.6 | 17 |

Samples Nos. 1 to 7, which represent the working examples of the present invention, are superior in both toughness in transverse direction and chip disposability as noted from Table 3.

By contrast, samples Nos. 8 to 13, which represent the comparative examples of the present invention, are not satisfactory as noted from Table 3.

Samples Nos. 8 and 9 have the values of a/b which exceed the upper limit specified in the present invention. They are poor in toughness in transverse direction on account of a large number of coarse sulfide inclusions. The reason for this is that they were prepared from an Al-containing molten steel incorporated with Mg alone or Mg and Ca in combination.

TABLE 1

| | C | Si | Mn | P | S | Ni | Cr | Al | Mg | Ca | O | N | Bi |
|---|---|---|---|---|---|---|---|---|---|---|---|---|---|
| 1 | 0.30 | 0.20 | 0.8 | 0.01 | 0.1 | 0.25 | 0.15 | 0.02 | 0.0015 | 0 | 0.001 | 0.008 | 0 |
| 2 | 0.30 | 0.20 | 0.8 | 0.01 | 0.1 | 0.25 | 0.15 | 0.02 | 0.0015 | 0.0015 | 0.001 | 0.008 | 0 |
| 3 | 0.30 | 0.20 | 0.8 | 0.01 | 0.06 | 0.25 | 0.15 | 0.02 | 0.0018 | 0 | 0.001 | 0.008 | 0 |
| 4 | 0.30 | 0.20 | 0.8 | 0.01 | 0.06 | 0.25 | 0.15 | 0.02 | 0.0014 | 0.0016 | 0.001 | 0.008 | 0 |
| 5 | 0.30 | 0.20 | 0.8 | 0.01 | 0.06 | 0.25 | 0.15 | 0.02 | 0.0015 | 0 | 0.001 | 0.008 | 0.02 |
| 6 | 0.30 | 0.20 | 0.8 | 0.01 | 0.06 | 0.25 | 0.15 | 0.02 | 0.0004 | 0 | 0.001 | 0.008 | 0 |
| 7 | 0.30 | 0.20 | 0.8 | 0.01 | 0.1 | 0.25 | 0.15 | 0.02 | 0.0005 | 0.0002 | 0.001 | 0.008 | 0 |
| 8 | 0.30 | 0.20 | 0.8 | 0.01 | 0.1 | 0.25 | 0.15 | 0.02 | 0.0015 | 0 | 0.001 | 0.008 | 0 |
| 9 | 0.30 | 0.20 | 0.8 | 0.01 | 0.1 | 0.25 | 0.15 | 0.02 | 0.0016 | 0.0014 | 0.001 | 0.008 | 0 |
| 10 | 0.30 | 0.20 | 0.8 | 0.01 | 0.1 | 0.25 | 0.15 | 0.02 | 0 | 0 | 0.001 | 0.008 | 0 |
| 11 | 0.30 | 0.20 | 0.8 | 0.01 | 0.1 | 0.25 | 0.15 | 0.02 | 0 | 0.0017 | 0.001 | 0.008 | 0 |
| 12 | 0.30 | 0.20 | 0.8 | 0.01 | 0.06 | 0.25 | 0.15 | 0.02 | 0 | 0 | 0.001 | 0.008 | 0 |
| 13 | 0.30 | 0.20 | 0.8 | 0.01 | 0.06 | 0.25 | 0.15 | 0.02 | 0.0018 | 0 | 0.001 | 0.008 | 0 |

unit: mass %

TABLE 2

| Sample | [Mg]/[S] | ([Mg] + [Ca])/(S) | Aspect ratio (1)* | Aspect ratio (2)* | a/b |
|---|---|---|---|---|---|
| 1 | 0.015 | 0.015 | 4.2 | 9.8 | 0.16 |
| 2 | 0.015 | 0.030 | 4.3 | 9.5 | 0.17 |
| 3 | 0.030 | 0.030 | 3.9 | 10.4 | 0.15 |
| 4 | 0.023 | 0.050 | 4.3 | 9.5 | 0.18 |
| 5 | 0.025 | 0.025 | 4.3 | 10.0 | 0.17 |
| 6 | 0.007 | 0.007 | 4.2 | 11.2 | 0.15 |
| 7 | 0.005 | 0.007 | 4.4 | 11.0 | 0.17 |
| 8 | 0.015 | 0.015 | 4.5 | 10.5 | 0.26 |
| 9 | 0.016 | 0.030 | 4.8 | 10.3 | 0.27 |
| 10 | 0 | 0 | 5.5 | 11.3 | 0.13 |
| 11 | 0 | 0.017 | 5.4 | 12.7 | 0.12 |
| 12 | 0 | 0 | 5.4 | 12.4 | 0.16 |
| 13 | 0.030 | 0.030 | 4.4 | 10.6 | 0.26 |

*Average aspect ratio of sulfide-type inclusions having major axes not shorter than 5 μm.

*Average aspect ratio of sulfide-type inclusions having major axes not shorter than 50 μm.

Sample No. 13, like samples Nos. 8 and 9, has the value of a/b which exceeds the upper limit specified in the present invention. They are superior to samples Nos. 8 and 9 in toughness in transverse direction on account of the lower S content. However, it is poor in chip disposability for the same reason mentioned above. The overall result lacks a balance between toughness in transverse direction and chip disposability.

Samples Nos. 10 to 12 are characterized in that the sulfide-type inclusions, regardless of whether their major axes are not shorter than 5 μm or not shorter than 50 μm, have an aspect ratio exceeding the upper limit specified in the present invention. Therefore, they are poor in toughness in transverse direction. This is ascribed to the fact that these samples do not contain Mg, which means that they entirely or slightly lack oxides to control the shape of sulfide-type inclusions. Thus, sulfide-type inclusions eventually take on an elongated shape, which leads to low toughness in transverse direction.

The above-mentioned results are graphed in FIG. 11, with the number of chips plotted against toughness in transverse direction. It is apparent that those samples according to the present invention have a good balance between these two properties.

Effect of the Invention

The present invention described above provides a machine structure steel which exhibits good chip disposability and mechanical properties despite its freedom from lead.

| 図面説 FIG. 1 | |
|---|---|
| 1 | Number of chips (pieces per gram) |
| 2 | Toughness in transverse direction ($J/mc^2$) |
| 3 | Examples |
| 4 | Comparative Examples |

What is claimed is:

1. A machine structure steel containing sulfide inclusions, wherein particles of the sulfide inclusions with major axes not shorter than 5 $\mu$m have an average aspect ratio not larger than 5.2; and $$a/b \leqq 0.25$$

where a denotes the number of particles of the sulfide inclusions with major axes not shorter than 20 $\mu$m, and b denotes the number of particles of the sulfide inclusions with major axes not shorter than 5 $\mu$m.

2. The machine structure steel as defined in claim 1, wherein the steel contains, in mass %, 0.01–0.7% C, 0.01–2.5% Si, 0.1–3% Mn, 0.01–0.16% S, not more than 0.05% P (0% inclusive), not more than 0.1% Al (0% inclusive), and not more than 0.02% Mg (0% not inclusive).

3. The machine structure steel as defined in claim 1, wherein the steel contains, in mass %, 0.01–0.7% C, 0.01–2.5% Si, 0.1–3% Mn, 0.01–0.16% S, not more than 0.05% P (0% inclusive), not more than 0.1% Al (0% inclusive), not more than 0.02% Mg (0% not inclusive), and not more than 0.02% Ca (0% inclusive).

4. The machine structure steel as defined in claim 1, wherein the steel contains, in mass %, 0.01–0.7% C, 0.01–2.5% Si, 0.1–3% Mn, 0.01–0.16% S, not more than 0.05% P (0% inclusive), not more than 0.1% Al (0% inclusive), not more than 0.02% Mg (0% not inclusive), and not more than 0.3% Bi (0% not inclusive).

5. A process for producing a machine structure steel, the process comprising adding a substantially Al-free Mg alloy to a substantially Al-free molten steel to form a molten alloy; and producing the steel of claim 1.

6. The process as defined in claim 5, wherein the process further comprises adding Al to the molten alloy.

7. The process as defined in claim 5, wherein the process further comprises adding a substantially Al-free Ca alloy to the molten alloy.

8. The process as defined in claim 7, wherein the process further adding Al to the molten alloy after the addition of the Ca alloy.

9. A process for producing a machine structure steel, the process comprising adding a substantially Al-free Mg alloy and a substantially Al-free Ca alloy together to a substantially Al-free molten steel one or more times to form a molten alloy; and producing the steel of claim 1.

10. The process as defined in claim 9, wherein the process further comprises adding Al to the molten alloy after the addition of the Mg alloy and the Ca alloy.

11. The process as defined in claim 5, wherein the process is carried out such that the molten steel is covered with a slag containing 15% or more MgO.

12. The process as defined in claim 9, wherein the process is carried out such that the molten steel is covered with a slag containing 15% or more MgO.

13. A process for producing a machine structure steel, the process comprising adding a substantially Al-free Mg alloy to a substantially Al-free molten steel to form a molten alloy;

adding a substantially Al-free Ca alloy to the molten alloy;

then adding at least one of the Mg alloy and the Ca alloy one or more times to the molten alloy; and producing the steel of claim 1.

14. The process as defined in claim 13, wherein the process further comprises adding Al to the molten alloy after the addition of the Mg alloy and the Ca alloy.

15. A machine structure steel containing Mg and S as components; and further containing sulfide inclusions, wherein $$[Mg]/[S] \geqq 7.7\times10^{-3}$$

where [ ] denotes the content in mass % of each component;

particles of the sulfide inclusions with major axes not shorter than 50 $\mu$m have an average aspect ratio not larger than 10.8; and $$a/b \leqq 0.25$$

where a denotes the number of particles of the sulfide inclusions with major axes not shorter than 20 $\mu$m, and b denotes the number of particles of the sulfide inclusions with major axes not shorter than 5 $\mu$m.

16. A machine structure steel containing Mg, Ca and S as components; and further containing sulfide inclusions, wherein $$([Mg]+[Ca])/[S] \geqq 7.7\times10^{-3}$$

where [ ] denotes the content in mass % of each component;

particles of the sulfide inclusions with major axes not shorter than 50 $\mu$m have an average aspect ratio not larger than 10.8; and $$a/b \geqq 0.25$$

where a denotes the number of particles of the sulfide inclusions with major axes not shorter than 20 $\mu$m, and b denotes the number of particles of the sulfide inclusions with major axes not shorter than 5 $\mu$m.

* * * * *